US005197934A

United States Patent [19]

Wirtz

[11] Patent Number: 5,197,934

[45] Date of Patent: Mar. 30, 1993

[54] ELASTIC EXERCISE DEVICE

[76] Inventor: Donald E. Wirtz, 914 N. M St., Tacoma, Wash. 98403

[21] Appl. No.: 642,679

[22] Filed: Jan. 17, 1991

[51] Int. Cl.[5] ..... A63B 21/02

[52] U.S. Cl. ..... 482/123; 482/126; 482/125

[58] Field of Search ..... 272/96, 135-139, 272/125; 128/25 B; 482/121, 122, 123, 126, 142

[56] References Cited

U.S. PATENT DOCUMENTS

| | | | |
|---|---|---|---|
| D. 209,759 | 1/1968 | Snyder . | |
| D. 288,108 | 2/1987 | Hata | D21/198 |
| 1,623,670 | 4/1927 | Frankenfeld | 272/138 |
| 1,691,092 | 11/1928 | Titus . | |
| 1,866,024 | 7/1932 | Gailey | 272/137 |
| 1,952,750 | 3/1934 | Gailey | 272/137 |
| 1,990,970 | 2/1935 | Wood | 272/96 X |
| 3,592,467 | 7/1971 | Pereira | 272/137 |
| 3,614,098 | 10/1971 | Carr | 272/79 R |
| 4,057,246 | 11/1977 | Wilson et al. | 272/137 |
| 4,059,265 | 11/1977 | Wieder et al. | 272/137 |
| 4,121,827 | 10/1978 | Wieder et al. | 272/137 |
| 4,159,111 | 6/1979 | Lowth | 272/96 |
| 4,195,835 | 4/1980 | Hinds et al. | 272/137 |

FOREIGN PATENT DOCUMENTS

| | | | |
|---|---|---|---|
| 2234017 | 1/1975 | France | 272/137 |

*Primary Examiner*—Robert P. Swiatek
*Assistant Examiner*—L. Thomas
*Attorney, Agent, or Firm*—Jensen & Puntigam

[57] ABSTRACT

An exercise device comprising a foot board (12) which includes two side-by-side foot receptacles (22,24) separated by a connecting element (36). Spring holder elements (40,42) extend from the outboard edges of the respective foot receptacles (22,24). Elastic members (14,16) are connected to and extend upwardly from the spring holder elements (40,42) terminating in individual handles (18,20).

6 Claims, 2 Drawing Sheets

ELASTIC EXERCISE DEVICE

TECHNICAL FIELD

This invention generally concerns exercise devices and more particularly is directed to an elastic exerciser which includes a footplate and spring elements which extend upwardly therefrom.

BACKGROUND ART

Physical fitness is very important in the lives of many people today and the importance of regular, consistent exercise in maintaining physical fitness is well-known. Frequently, particular exercise directed toward muscle building or toning is carried out with specialized equipment. The equipment available is extremely varied, both in complexity and expense, from relatively simple free weight devices or exercise bars, to large and complex systems which are useful for a large variety of exercises and which are typically quite expensive.

The present invention is directed toward an equipment item which is used to tone selected muscle groups without great exertion, using spring resistance. Such exercisers are generally known, as demonstrated by the following U.S. Pat. No. 1,691,092 to Titus, No. 4,059,265 to Wieder et al, No. 4,195,835 to Hinds et al, and Design Patent No. 288,108 to Hata. All of these devices disclose particular combinations of stretchable cords or springs, hand grips or bars which are attached to one end of the springs, and various arrangements of foot boards to which the other end of the springs are attached. However, these devices, as well as other similar devices, while effective to an extent, are not optimized in terms of design and/or structural arrangement so as to provide maximum benefit for a given amount of effort. Typically, this is due either to differences in the arrangement and position of the elastic spring member or members, the configuration and arrangement of the foot board, and/or the structural relationship between the foot boards, the elastic elements and the hand grips.

The present invention is an elastic exerciser which comprises a specific configuration of and arrangement of elements intended to provide better and more complete exercise results.

DISCLOSURE OF THE INVENTION

Accordingly, the present invention is an exercise device which includes a rigid footplate member, including first and second foot portions, which are adapted to receive the feet of the user, a rigid connecting member which extends between the first and second foot portions for separating the foot portions by a selected distance and elastic member receiving elements which are located outboard of the foot portions, at approximately shoulder width of the user. The exercise device further includes elastic members which are connected to, and extend upwardly from the elastic member receiving means, and handle means which are connected to the upper ends of said elastic members.

BEST MODE FOR CARRYING OUT THE INVENTION

Figure 1:
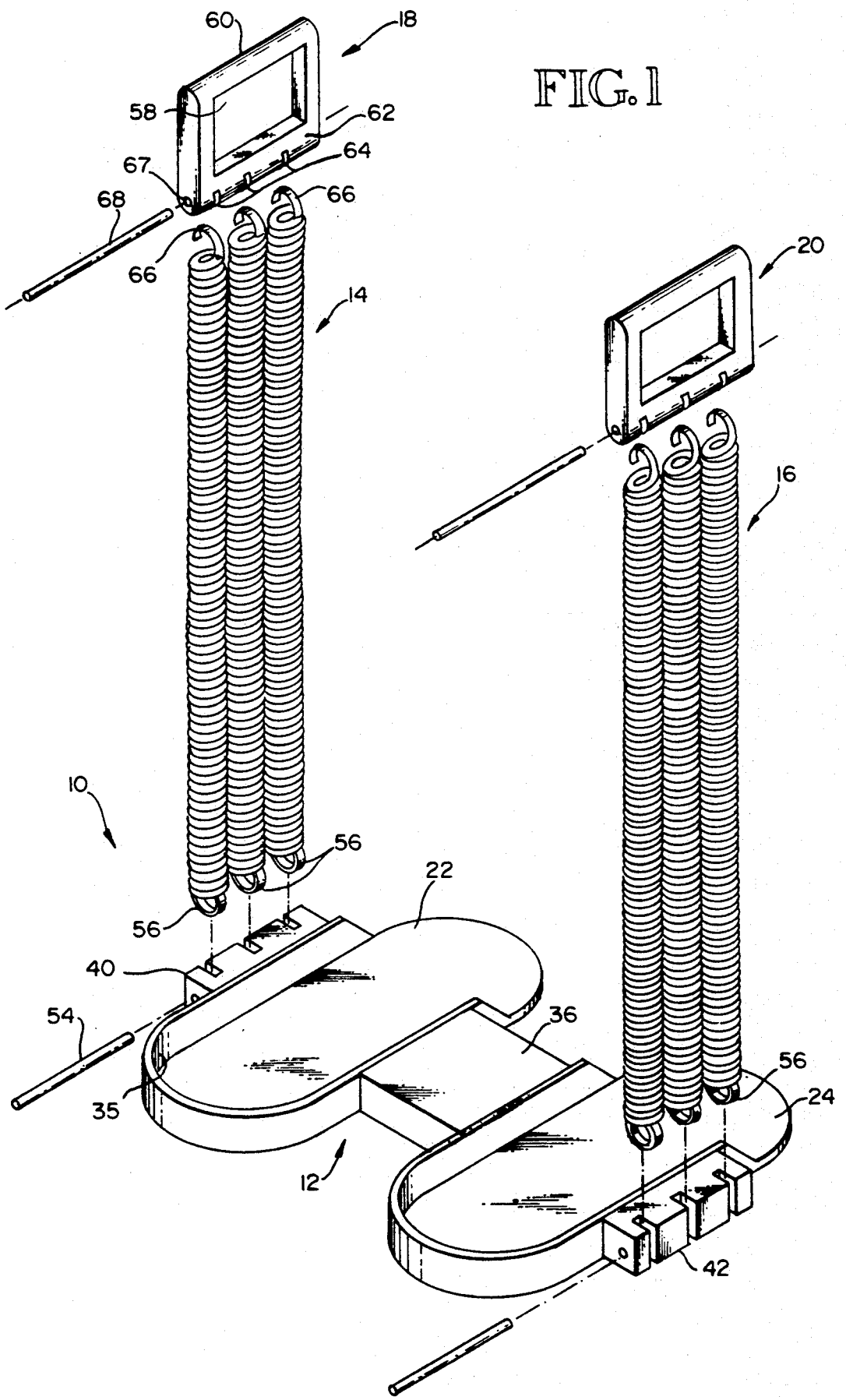
FIG. 1 is an isometric, exploded view showing the elements of the exercise device of the present invention and their structural relationship to each other.

FIG. 1 shows the exercise apparatus of the present invention, referred to generally at 10. The exercise apparatus 10 includes a foot board shown at 12 which includes separate stirrup-like receptacles for each foot. Extending upwardly from the foot board 12 are two pluralities of spring elements 14 and 16, each plurality of spring elements being located slightly outboard of each foot receptacle. Secured to the upper ends of springs 14 and 16 are individual handles 18 and 20 which are configured so as to provide the user a convenient grip. In one anticipated manner of use of the apparatus, the foot board 12 is placed on the floor and the user stands with his feet in the respective receptacles. The user then grips the handles and pulls them vertically against the action of the spring elements, resulting in the enhancement of the upper body/arm muscles. The apparatus could also be beneficial when the user is in a crouched position, or the user could use the apparatus lying on the floor, with feet in the receptacles.

Figure 2:
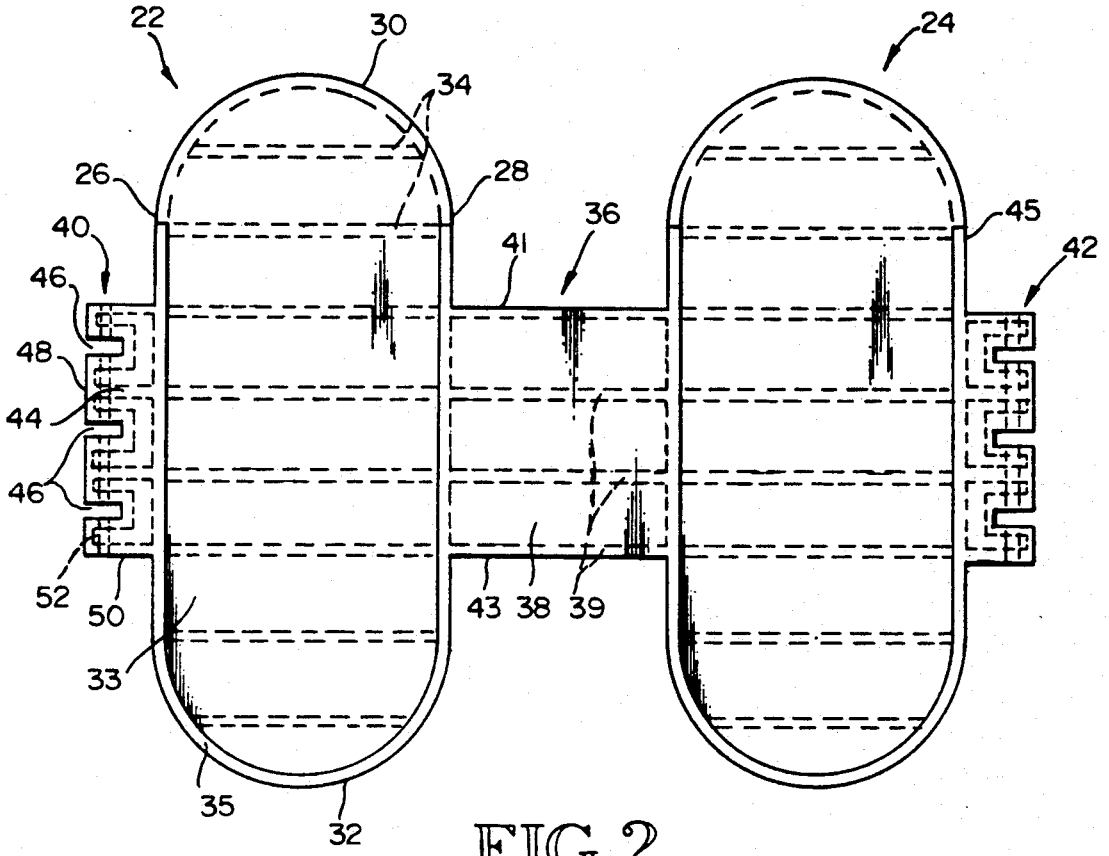
FIG. 2 is a top view of the foot board portion of the exercise device of FIG. 1.
Figure 3:
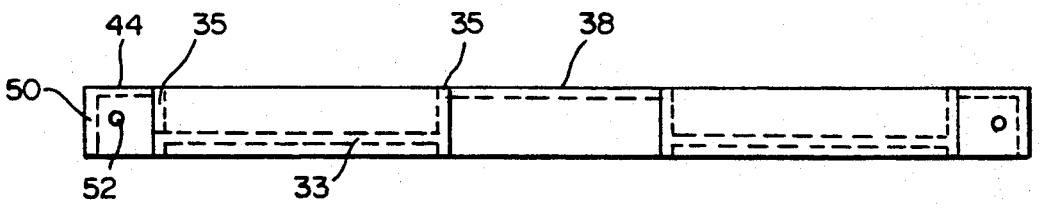
FIG. 3 is an elevational view of the foot board of FIG. 2.

FIGS. 2 and 3 show the details of the foot board 12. As briefly described above, the foot board 12 includes two foot receptacles 22 and 24. Each foot receptacle in the embodiment shown is approximately 13 inches long and 5½ inches wide. The opposing sides of each receptacle, e.g. sides 26 and 28 of receptacle 22, are straight, with opposing end portions 30 and 32 being curved in the shape of a hemisphere. Each receptacle includes a footplate 33, the upper surface of which is flat. Footplate 33 is bounded by a relatively thin wall 35 which extends approximately 0.9 inches above the surface of plate 33 (upper portion) and approximately 0.15 inches below plate 33 (lower portion). The upper portion of wall 35 extends only around the sides and rear of the footplate, while the lower portion extends around the entire periphery thereof, as shown in FIG. 2. Depending from the lower surface of plate 33 and laterally thereacross, are a plurality of reinforcing ribs 34, positioned at intervals which vary from 1.42 inches to 1.57 inches. The ribs 34 extend downwardly approximately 0.15 inches so that they are flush with the lower edge of the lower portion of the boundary wall 35.

Extending between the two foot receptacles 22, 24 is a connecting element 36. The connecting element is in the embodiment shown approximately 4 inches long (between the receptacles 22, 24) and approximately 3½ inches wide. The connecting element 36 includes a plate 38 which is flush with the top edge of the upper portion of boundary walls 35 of the respective foot receptacles 22 and 24. The connecting element 36 also includes a plurality of ribs 39 which are a continuation of the reinforcing ribs 34 of the receptacles 22 and 24, including two ribs 39 which are located at the upper and lower edges 41, 43 of connecting element 36.

The foot board 12 further includes two spring holder elements 40 and 42, which are positioned at the outboard sides 26 and 45 of both foot receptacles 22 and 24. Each spring holder (spring holder 40 is exemplary) is approximately 4½ inches long by 1¼ inches wide. It includes a flat plate 44 with three rectangular openings or slots 46 extending inwardly thereof from the outside free edge 48 thereof. The plate 44 is flush with the upper edge of the upper portion of boundary wall 35. In the embodiment shown, the slots 46 are ¼ inch wide and approximately ¾ inch long. Extending downwardly from plate 44 and conforming to the outline thereof, is a depending wall 50 which in the embodiment shown is approximately 1¼ inches high. Slots 46 are present in wall 50 also, as shown. Reinforcing ribs in registry with ribs 34 extend across the spring holder elements, depending downwardly from the lower surface of plate 44, between slots 46, to provide additional stiffening for the spring holder elements.

An opening 52 extends lengthwise through each spring holder element, located approximately 0.45 inches inward from edge 48, and extends through slots 46 and the depending wall 50. As discussed further below, this permits connection of the lower end of the spring members in the spring holder elements. While three slots have been shown in the spring holders of the embodiment shown, thereby accommodating three individual spring members, it should be understood that the spring holders could be of a different size and configuration, or have a different number of slots, so as to accommodate a different number of spring members.

The foot board 12, comprising, as discussed above, the two foot receptacles 22 and 24, the connecting member 36 and the spring holders 40 and 42, is typically in the form of an integral unit and can be readily produced from a mold. Although the material comprising the foot board would typically be high-strength plastic, it should be understood that other high-strength materials could also be used.

Referring again to FIG. 1, the spring members 14, 16 are, in the embodiment shown, elongated, cadmium plated springs. The tension of and the exact length of the springs are selected to provide desired muscle toning/training effect. Variations of the invention, in the form of different commercial models, may be made using different spring lengths and different spring tensions, to accommodate different groups of users. At the lower end of each spring member is a loop 56 for attachment to the spring holders 40, 42 of foot board 12. The end loops 56 of the spring members are inserted into the slots 46 in the respective spring holders 40 and 42, and then a rod 54 is inserted through the opening 52, extending across the slots and through the end loops 56. This arrangement permits rapid connection and removal of the spring members 14, 16 to the foot board 12. While the spring members are illustrated herein specifically as springs, they could also be other types of spring members, including stretchable cord.

The handles for the exercise apparatus are also shown in FIG. 1. The handles 18, 20 are basically rectangular in configuration with a central opening 58 (handle 18 is exemplary) large enough to accommodate the user's hands. The upper portions 60 of each handle are curved in cross-section in the embodiment shown so as to facilitate ease and comfort of gripping the handles. Each handle 18 and 20 has three lateral slots 64 in the lower surface of the lower portion 62 thereof, extending laterally across the lower portion 62. The slots 64 are wide enough and deep enough to accommodate end loops 66 at the top end of the spring members. A longitudinal opening 67 extends the length of the lower portion 62 of the handle across all of the slots 64. A retaining bar 68 is then pushed through opening 64 and the end loops 66 at the top ends of the springs, thereby retaining end loops 66 in slots 64. This arrangement provides a reliable connection between spring members 14 and 16 and handles 18 and 20. As with the foot board 12, the handles 18 and 20 are made from a high-strength plastic and can be produced from a mold.

The exercise apparatus is relatively lightweight and easy to store yet is also extremely strong. If necessary, the spring members can be conveniently disconnected from both the foot board 12 and the handles 18 and 20 for ease of storage and/or transport.

As briefly explained above, the person exercising places his feet in the foot receptacles and grasps the handles. The handles are then pulled vertically, and perhaps slightly outwardly as well. This provides a significant training effect for the entire upper body region. The foot board and spring members are arranged such that the springs are approximately at shoulder width, i.e. the distance between the opposing spring holders 40 and 42 is approximately should width. When the device is used, such an arrangement has the effect of providing specific muscle isolation.

Although a preferred embodiment of the invention has been disclosed herein for illustration, It should be understood that various changes, modifications and substitutions may be incorporated in such embodiment without departing from the spirit of the invention which is defined by the claims which follow:

I claim:

1. An exercise device, comprising:

rigid foot board member, including first and second foot portions adapted to receive the feet of the user, each foot portion having a width approximately equal to that of a human foot and at least partially bounded by a short wall portion preventing movement of the foot therein, the foot board member further including a rigid connecting member, extending between the first and second foot portions for separating the foot portions by a selected distance, and elastic member receiving elements located substantially immediately outboard of the foot portions, at approximately shoulder width of the user;

elastic members connected to, and extending upwardly from, the elastic member receiving means; and handle means connected to the upper ends of said elastic members.

2. An apparatus of claim 1, wherein the elastic members comprise a plurality of springs, each spring having upper and lower ends, the lower ends of the springs, respectively, connected successively along the elastic member receiving means, parallel with the foot portions, in a region located approximately mid-length of the foot portions.

3. An apparatus of claim 2, wherein each elastic member comprises three springs.

4. An apparatus of claim 2, including means for removably connecting the elastic members to the foot board member and the handle means.

5. An apparatus of claim 2, wherein the elastic member receiving means extends outwardly from the outboard edges of each foot portion, each of said elastic member receiving means including three lateral slots and a longitudinal opening extending therethrough, wherein the slots are adapted to receive end portions of the elastic members, and wherein the elastic member receiving means further includes a retaining rod which extends through said opening and through the end portions of the elastic members, thereby connecting the elastic members to the elastic member receiving means.

6. An article of claim 5, wherein each foot portion includes a flat plate-like element substantially in the form of an elongated oval, wherein the underside of the flat plate includes a plurality of rib-like projections which extend downwardly from the plate-like element, and wherein the connecting element includes a flat plate-like portion which extends between the two foot portions and also includes a plurality of rib-like projections extending downwardly therefrom, the entire footplate member being a unitary molded element of high-strength plastic.

* * * * *